US005393209A

United States Patent [19]

Mohr et al.

[11] Patent Number: 5,393,209

[45] Date of Patent: Feb. 28, 1995

[54] DOUBLE-ENDED CERAMIC HELICAL-ROTOR EXPANDER

[75] Inventors: Peter B. Mohr; Wendell B. Myers, both of Livermore, Calif.

[73] Assignee: The United States of America as represented by the United States Department of Energy, Washington, D.C.

[21] Appl. No.: 38,421

[22] Filed: Mar. 29, 1993

[51] Int. Cl.[6] ..... F01C 1/24

[52] U.S. Cl. ..... 418/202; 418/152; 418/179

[58] Field of Search ..... 418/202, 152, 179; 123/204

[56] References Cited

U.S. PATENT DOCUMENTS

| | | | |
|---|---|---|---|
| 698,539 | 4/1902 | McBride . | |
| 1,135,648 | 4/1915 | Ahlm et al. . | |
| 1,534,182 | 4/1925 | Lithgore | 418/202 |
| 1,708,891 | 4/1929 | Montelius | 418/202 |
| 2,289,371 | 7/1942 | Lysholm et al. | 103/128 |
| 2,410,172 | 10/1946 | Lysholm | 230/143 |
| 2,466,888 | 4/1949 | Garraway | 418/202 |
| 2,799,253 | 7/1957 | Lindhagen et al. | 121/70 |
| 2,920,971 | 1/1960 | Stookey | 106/39 |
| 3,102,681 | 9/1963 | Nilsson | 230/143 |
| 3,307,453 | 3/1967 | Nilsson et al. | 91/84 |
| 3,310,043 | 3/1967 | Gamage | 123/12 |
| 3,847,518 | 11/1974 | Prasse et al. | 418/122 |
| 3,881,849 | 5/1975 | Commarmot et al. | 418/182 |
| 4,293,619 | 10/1981 | Landingham et al. | 428/623 |
| 4,385,665 | 5/1983 | Ochiai et al. | 416/185 |
| 4,684,335 | 8/1987 | Goodridge | 418/202 |

FOREIGN PATENT DOCUMENTS

| | | | |
|---|---|---|---|
| 0401658 | 9/1966 | Australia | 418/179 |
| 0160585 | 9/1983 | Japan | 418/179 |
| 0066882 | 4/1986 | Japan | 418/179 |

*Primary Examiner*—Richard A. Bertsch
*Assistant Examiner*—Charles G. Freay
*Attorney, Agent, or Firm*—Miguel A. Valdes; Henry Sartorio; William R. Moser

[57] ABSTRACT

A ceramic helical rotor expander using a double-ended or tandem herringbone type rotor arrangement with bearing and seal assemblies remote from the hot gas inlets and especially capable of operating at an inlet temperature of above 1100° C. The rotors are solid or hollow and bonded to hollow metal shafts, and mounted in a composite or simple prismatic casing. The rotors, casing and shafts are constructed from low expansivity materials. In the preferred embodiment the rotors are constructed of silicon nitride and the shafts constructed of an molybdenum alloy, with the metal shafts being supported in bearings and secured to synchronizing gears. The rotors and casing may be provided with coolant channels therein, and are constructed to eliminate the problem of end leakages at inlet temperature and pressure, and the need for high temperature bearings and seals.

22 Claims, 3 Drawing Sheets

DOUBLE-ENDED CERAMIC HELICAL-ROTOR EXPANDER

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to an apparatus using opposed "herringbone" type rotors for expanding a gaseous medium, more specifically to a ceramic helical rotor expander utilizing low expansivity ceramic and/or metal materials, and specifically to a double-ended helical-rotor expander constructed to operate at an inlet temperature above 1100° C.

Positive displacement expanders (expansion engines) depend on precise and dependable enclosure of the working fluid, usually a hot gas, while it expands (and cools) within the elements of the machine in such a manner as to transmit a moving force to an external load. In the helical rotor expander, two fluted rotors mesh precisely together within intersecting cylinders (bores) so as to contain working gases in an expanding volume, exert direct pressure forces on the lobes of the rotors so as to cause forceful turning of the output shaft.

In the helical rotor expander, close clearances alone are used to contain the working gases. This puts a premium on precise and stable fit between the rotors and with the case. This is possible with common metals, steel, aluminum, etc. only within a material temperature range of a few hundred degrees.

The helical rotor expander has no reciprocating, sliding, or abrading components which cause unbalance or require lubrication, and all the supporting components (bearings and seals) are external to the working space. Thus, the helical rotor expander has a smooth operation and no drag or wear in the working space.

The problem with successful construction of helical rotor concept engines operating on combustion products has been distortion of the closely fitting components, rotors and case under the thermal expansion of metal components induced by exposure to high, but rapidly changing temperature of the burning and/or expanding gases. In the helical rotor machine, the flow of the hot gases through the expander is quasi-continuous such that exposed components are either heated to gas temperature if uncooled or extract substantial energy from the gases if cooled. The former would result in substantial distortions in the relatively high expansion of common materials and would require excessive clearances. The latter would result in a substantial compromise in performance and efficiency.

In the early helical type expanders, problems due to the thermal deformation of the rotors and casings, and losses due to leakage and cooling, rendered it practically impossible to utilize sufficiently high temperatures and to retain the small clearances required for efficient operation. Thus, the efficiency of these early helical rotor machines was low, and thus not capable of competing with other machines, such as the gas turbine.

However, with the continued improvement in low expansivity materials capable of withstanding higher temperatures, and means for their manufacture, the difficulties arising from the thermal deformations of previous concepts are being overcome. With the advent of ceramic materials and the capability of producing casings and rotors from these materials, the herringbone type rotor systems, be they compressors, pumps, or expanders, provide advantages and competition with other machines, such as the gas turbine. The development of the helical rotor systems is exemplified by U.S. Pat. No. 698,539 issued Apr. 29, 1902 to T. C. McBridge; U.S. Pat. No. 1,135,648 issued Apr. 13, 1915 to C. E. F. Ahlm et al.; U.S. Pat. No. 2,289,371 issued Jul. 14, 1942 to A. Lysholm et al.; U.S. Pat. No. 2,410,172 issued Oct. 29, 1946 to A. Lysholm; U.S. Pat. No. 2,799,253 issued Jun. 16, 1957 to T. I. Lindhagen et al.; U.S. Pat. No. 3,102,681 issued Sep. 3, 1963 to H. R. Nilsson; U.S. Pat. No. 3,307,453 issued Mar. 7, 1967 to H. R. Nilsson et al.; and U.S. Pat. No. 3,881,849 issued May 6, 1975 to R. Commarmot et al.

As pointed out above, with the development of ceramic helical rotor machines in the early 1960's, efforts have been going forward to develop machines using the helical rotors. Ceramic-materials have sufficient strength at high temperatures and low expansivity and heat conductivity as compared with aluminum or steel, for example, and which further can be molded and machined with great accuracy. Of the above-referenced prior art approaches U.S. Pat. Nos. 3,307,453, and 3,881,849, utilize ceramic materials, with U.S. Pat. No. 3,307,453 teaching the use of ceramic materials in both the rotors and chamber walls. As pointed out above, it is widely recognized that in helical rotor machines, the efficiency of operation is largely dependent upon the closeness of the clearances between the rotors and between the rotors and the housing, and the precision with which these relationships can be maintained in service. This in turn is dependent upon the materials and accuracy of construction of the rotors and housing, and upon the bearings for supporting the rotors in a centered and aligned arrangement with respect to each other and the casings in which the rotors operate and the maximum operating temperature.

Thus, there has been a long felt need for materials which can withstand the high temperatures and which can be machined with accuracy. The above-referenced need exists in helical rotor expanders capable of operation at higher (i.e. 1100° C.) inlet temperatures, useful for many applications in both propulsion, auxiliary and stationary power sources, and also for larger scale applications when the manufacturing capability is realized.

The present invention provides a helical or herringbone rotor expander particularly useful in applications for economical engines due to the present capability to manufacture such expanders. More specifically, the present invention involves a ceramic helical expander comprising a double-ended unit with hot gas entering at mid-length on one side and splitting to exhaust at both ends on the opposite side, and eliminates the problem relative to location of bearings and seals near the hot gas inlet. The helical rotor expander of this invention is of low expansivity, but high temperature material construction, made primarily of reaction bonded silicon nitride, for example. Also, the expander of this invention has the capability of operating at an inlet temperatures above 1100° C. Thermal distortions are made tolerable by resort to the low expansivity materials, principally refractory, e.g. ceramic, materials. This principle has been successfully demonstrated by a 1500° C. inlet temperature helical rotor expander made of graphite, a low expansivity refractory material, but not compatible with combustion gases. With the development and application of low expansion and combustion product resistant ceramics, such as silicon nitride, and the means for ready manufacture of the casings and herringbone rotors from this material, applications involving combustion products are now possible.

SUMMARY OF THE INVENTION

It is an object of the present invention to provide a ceramic helical rotor expander using low expansivity materials.

A further object of the invention is to provide a double-ended ceramic helical rotor expander, with the hot gas inlet remote from the bearings.

A further object of the invention is to provide a helical rotor expander wherein at least the rotor and/or the casing are primarily constructed of low expansivity ceramic materials, such as reaction bonded silicon nitride.

It is another object of this invention to provide a ceramic helical rotor expander capable of operating with an inlet temperature of at least 1100° C. with little or no internal cooling.

Another object of the invention is to provide a double-ended helical rotor expander primarily constructed of reaction bonded silicon nitride ($Si_3N_4$).

Another object of the invention is to provide a double-ended helical rotor expander wherein at least the rotors and casings are primarily constructed of silicon nitride and has the capability of operating, for example, at an inlet temperature of 1100°-1400° C.

Other objects and advantages will become apparent and such are carried out by a ceramic helical rotor expander which basically involves doubled-ended rotors in opposed tandem sets with bearing assemblies being remote from the hot gas inlet and the major components being constructed from low expansivity materials. The double-ended herringbone rotor arrangement eliminates hot end leakages and allows operation at higher temperatures. The rotors operate in a simple prismatic casing having all bores machined in a single set up, thus reducing the costs of manufacture. The rotors may be solid or hollow core (e.g. silicon nitride), bonded (in opposing pairs) to a low expansivity and high stiffness hollow (e.g. molybdenum or tantalum alloy) shaft. High temperature, high density ceramic or metal rolling element bearings support the rotor shafts and are located remotely from the hot inlet gases. The expander uses remotely located synchronizing gears which allows the use of an alloy steel, for example, with low pressure angles and large addendum/dedendum, lubricated and cooled to limit expansions to essentially those of the ceramic components.

BRIEF DESCRIPTION OF THE DRAWINGS

The drawings, when taken in conjunction with the description of invention, sets forth the principles upon which the present invention is based.

DETAILED DESCRIPTION OF THE INVENTION

Figure 1:
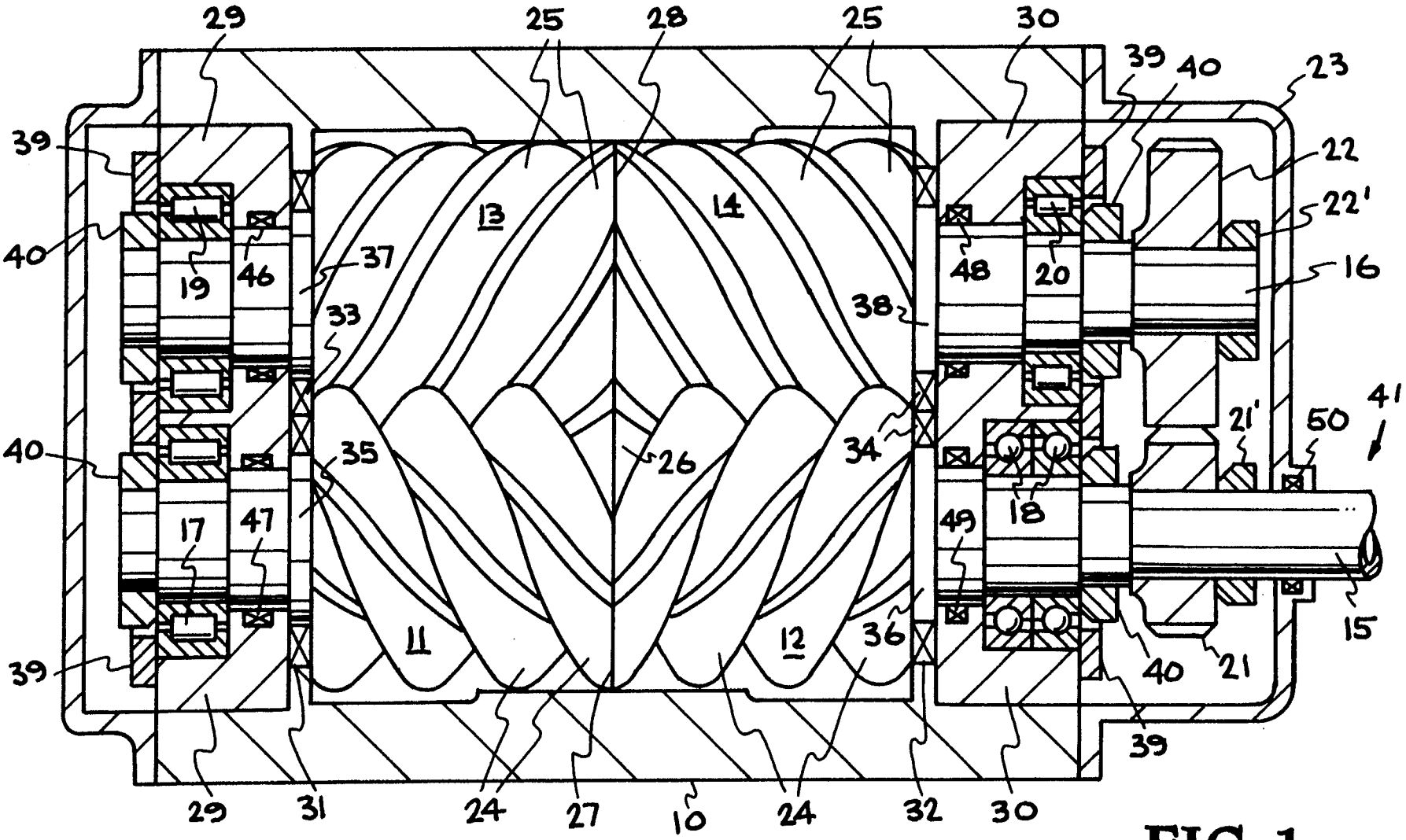
FIG. 1 is a plan view of an embodiment of the ceramic helical rotary expander made in accordance with the invention, with a portion of the casing removed to illustrate the rotors, shaft and bearing arrangement therein.

The present invention is directed to a double-ended ceramic helical rotor expander made with low expansivity material and with the hot gas inlet being remote from the bearings. The expander has the capabilities of operating at temperatures in the range of 1100°-1400° C., for example. Thus; this invention provides an alternative to the gas turbine for use in auxiliary power units, for various applications such as aircraft, pilotless tactical and reconnaissance vehicles, as well as for stationary and mobile applications. With the development of the ceramic materials and the capability to manufacture the rotary expander components therefrom, the remaining technical problem of the "hot end" bearing and seal arrangement has been resolved by this invention. This is accomplished by the use of opposed helical rotors set in tandem (end-to-end) so as to eliminate the hot end rotor-to-case leakage path, hot end shaft seal and adjacent bearings. By this rotor arrangement the bearings and seals are remotely located with respect to the hot gas inlet. The tandem rotor configuration increases flexibility in the rotor which is compensated for by the use of high elastic modulus (stiffness)—but low thermal expansivity—metal alloys, such as molybdenum or tantalum, for the rotor support shaft.

The present invention solves two principal and one subsidiary features relating to high temperature (and therefore higher power and higher efficiency) application of the helical rotor expander, these being: 1) the use of low thermal expansivity materials, 2) the elimination of bearings and seals adjacent to the high temperature (inlet) gases and working components, and 3) the capability to manufacture the tandem rotors and casings from low expansivity (ceramic) materials.

The adaptation of low thermal expansivity materials—metals and ceramics—for helical rotor expander components, i.e., the rotor, shaft, and casing, thus permits high temperature (above 1100° C.) operation with little or no internal cooling. It has been established during the development of this invention that certain classes of readily manufactured technical ceramics can exhibit the necessary strength and low expansion properties while retaining the facility for precise and economical manufacture using shaped (profile) tools. These characteristics are best exemplified by reaction bonded silicon nitride (RBSN), which when fully reacted in situ to (less than theoretical) densities on the order of 2.2-2.4 grams per cubic centimeter, or higher where pre-reacted materials are included, demonstrates: 1) long time fatigue strengths, in the temperature range to 1350° C., of 50 to 100 million Pascals—MPa—(7,000 to 14,000 pounds per square inch); 2) low thermal expansivity, of the order 2 to 3 microstrain per K (millionths of an inch per inch per degree Celsius); and 3) ready machinability to the necessary precision using cubic boron nitride profile cutters.

The elimination of need for bearings and seals, both precision and heat sensitive components, adjacent to the high temperature (inlet) gases and working components are provided by the opposed tandem rotor ("herringbone") expander of this invention. In the opposed tandem rotor, the high temperature inlet (working) gases enter the casing and rotors at the mid-plane and flow towards both ends such that the gases adjacent to the casing ends, bearings and seal are adjacent to the exhaust (lowest temperature) condition. This permits the use of more readily available bearing and seal technologies comparable to those of existing turbines and turbosuperchargers.

The invention enables the manufacture of components utilizing the precise bonding of low expansivity (ceramic—i.e. silicon nitride) rotor shapes (in tandem) to (compatible) low expansivity support shafts—e.g., of molybdenum or tantalum alloy—using the techniques of in situ reaction bonding.

The illustrated embodiment of the invention as set forth in the drawings and the detailed description thereof as set forth hereinafter, including the exemplified specifications, are to enable a better understanding of the principles of this invention. Such is not intended to limit the advance in this art, as provided by this invention, namely, the use of low expansivity materials and the tandem rotor arrangement wherein the hot fluid inlet is remote from the support bearings. The illustrated/described embodiment of the ceramic helical rotor expander of this invention utilizes, for example, a 125 to 127.5 mm rotor diameter with rotors in opposed tandem sets. The purpose of the tandem herringbone rotor arrangement is to eliminate end leakages at inlet temperature and pressure and the need for moving components—bearings and seals—away from the hot inlet. The rotors operate within a simple prismatic case having bore features machined in a single set up. The rotors, for example, may be solid or hollow core, bonded (in opposing pairs) to a low expansivity (and high stiffness) hollow metal (molybdenum or tantalum alloy) shaft. High temperature, high density ceramic rolling element bearings, for example, are used within the limiting temperature of "synthetic" lubricating fluids and solid lubricant additives. The bearing and seal requirements are analogous to those of an exhaust driven turbosupercharger. Synchronizing gears between the rotor shafts may be of alloy steel with low pressure angles and large addendum/dedendum, lubricated and cooled to limit expansions to essentially those of the ceramic components. These features are set forth by way of example only in the drawings and the following Specifications Table, and such is not intended to limit the invention to the parameters, configurations, etc., illustrated or set forth in the following Specification Table.

SPECIFICATIONS TABLE 125 and 127.5 mm (rotor diameter) "Herringbone" Ceramic Helical Expanders

| | | |
|---|---|---|
| Silicon Nitride Rotor & Case Dimensions: | | |
| 4 & 6 lobe rotors with circular or asymmetric profile & equal outside diameters. | | |
| Rotor Outside Diameter: (D) | | |
| Circular Profile/ | | 125 mm/ |
| Asymmetric Profile | | 127.5 mm |
| Center-to-center distance: | .800/.785 D | ~100 mm |
| P.D. Male: (0.4 C-C) | .640/.6276 D | 80 mm |
| P.D. Female: (0.6 C-C) | .96/.94 D | 120 mm |
| Lobe/Gully Dia. (d) | (.384/.379 D) | (45–48 mm) |
| Rotor Length: (L/D) | ~2.0 D* | 250 mm |
| Misc. (Rotors): | | |
| Bore (Core & Rough Shaft) Dia. | ~.4 D | 51 mm |
| Root Dia., Female | .565 D | 72 mm |
| Root Dia., Male | .568 D | ~72.5 mm |
| Spigot Dia.: | (.5–.55 D) | — |
| Shaft and Seal Dia.: | ~~4D | ~50 mm |
| Bearing Dia: | ≦~.4D | ~50 mm |
| I.D. (finish shaft O.D.) | | |
| Synchronization | Straight cut spur @ rotor PD (or metal tape) | |
| Displacement: | | |
| Circular Profile | ~.413 L/D D**3 | ~1.8 liter |
| Asymmetric Profile | ~.445 L/D D**3 | ~2.0 liter |

SPECIFICATIONS TABLE-continued 125 and 127.5 mm (rotor diameter) "Herringbone" Ceramic Helical Expanders

| | | |
|---|---|---|
| Ceramic Case | | |
| Prismatic, eight sided - oblate octagon, .2D minimum wall thickness (based on 125 mm rotor) | | |
| Height (minor dia.) approx. | ~1.4 D | ~177.5 mm |
| Width (major dia.) approx. | ~2.2 D | ~280 mm |
| Length: | | |
| Bores (finish): | 250/255 mm | ~2.0 D net |
| Overall: | | ~~400 mm |
| Component Weights (approximate): | Kg. | |
| Ceramic Case: | 7.0 | |
| Rotors (w/metal shafts): | 5.0 | |
| Gears, Seals, Couplings: | 2.0 | |
| Total (bare) | 14.0 Kg | |

*i.e. two opposed helix (herringbone) rotors in tandem; 1.0 L/D each

Manufacture

The partially nitrided material can be machined with common steel machine tools and can be fired to the fully reacted condition with very little, less than 0.1%, change in dimension. Critically dimensioned surfaces are then machined to finish dimension to an accuracy of less than 0.02% using hard diamond or cubic boron nitride tooling. Since the properties of the fully dense (e.g. hot pressed) material are not required for this invention, there is some freedom in adjusting material density and strength for machining ease.

For the components of the expander, there are two basic approaches to the final machining step: 1) for simple circular features, open wheel grinding may be employed, 2) for variable profiles either abrasive (e.g. diamond or boron nitride) loaded profile cutters in fly cutting or routing configuration may be employed or alternatively open grinding under five axis numerical control. Recent developments in machines, abrasive tools and numerical control have substantially reduced costs for machine components.

The finished machined (silicon nitride) rotors are reaction bonded to metal (molybdenum) shafts and the shaft journals then finish machined for best mating geometry. The casing or case cavity is finish machined in the bores, inlet and end faces only. Bearings and seals are mounted within inserts indexed to bore features. Only one end of the male rotor shafts is axially indexed—i.e. provided with a thrust bearing. The female rotor is rotationally synchronized, but otherwise axially free to self center (as a consequence of the relatively acute helix angle) by the herringbone feature of the opposing rotor lobes.

A bushing for the hot gas inlet is inset in the casing wall at the midplane, centered over the mesh line of the rotors and will incorporate a diamond shaped porting geometry which determines desired pressure ratio. Thermal insulation is placed over the casing surrounding the inlet port. The exhaust may exit at both ends unducted to the environment or ducted to a static or rotary regenerator.

Referring now to the drawings, the embodiment illustrated comprises a case, casing or housing 10, within which are located two sets or tandem pairs of double-ended hollow core male and female rotor assemblies 11, 12 and 13, 14 each set being secured to a hollow shaft 15 and 16, respectively, having different diameter sections thereof, and mounted in case 10 via bearing assemblies generally indicated at 17, 18 and 19, 20, respectively, with hollow shafts 15 and 16 being provided with synchronizing gears 21 and 22 located within a lube cage or housing 23. Gears 21 and 22 are retained on shafts 15 and 16 by rings 21' and 22'. As seen in FIG. 3, the hollow core male rotor assemblies 11 and 12 are each typically provided with four (4) lobes or convex protrusions 24 and the mating hollow female rotor assemblies 13 and 14 are provided with six (6) mating grooves or concave sections 25. As known in the art the male and female rotor assemblies are mounted such that lobes 24 of the male rotors extend into certain of the grooves 25 of the female rotors. The midplane joining of tandem pairs of rotors defines an intake zone 26 (see FIG. 1) located at the point where the lobes or the grooves of the two tandem pairs of rotors interconnect and intermesh. A pair of exhaust zones 26' located at the outer edges of the rotors are seen in FIGS. 2 and 3. The lobes 24 on male rotors 11 and 12 extend in opposed helices along an axis away from a plane or point of interconnection at 27, while the grooves 25 on female rotors 13 and 14 extend similarly from a plane or point of interconnection at 28.

Case 10 includes end closures or plates 29 and 30 with bearing assemblies 17 and 19 mounted in bores in end plate 29 and bearing assemblies 18 and 20 mounted in bores in end plate 30. Located between casing 10 and end plates 29 and 30 are face seal assemblies 31, 32, 33 and 34. The male rotors 11 and 12 are reaction bonded onto shaft 15 as indicated at 35 and 36 and female rotors 13 and 15 are reaction bonded onto shaft 16 as indicated at 37 and 38. The bearing assemblies 17–20 are retained in case end plates 29 and 30 by rings or flanges 39 which are secured to end plates 29 and 30 and by bearing seats 40 secured to shafts 15 and 16. Note that bearing assembly 18 differs in construction from bearing assemblies 17, 19 and 20 in that it incorporates features that includes two opposed sets of ball bearings and constitutes a thrust bearing for shaft 15, in that shaft 15 constitutes the power take-off (PTO) indicated at 41 for the expander which is adapted to be connected to a point of use. Note that the bearing assemblies and synchronizing gears are positioned on different diameter sections of the shafts.

As seen in FIGS. 2 and 3, the case 10 is provided with a central hot gas intake or inlet port or opening 42 and a pair of exhaust or outlet ports or openings 43. Intake port 42 is connected via flange 44 to a source of hot gas via a supply conduit or line 45, while exhaust ports 43 are connected to exhaust outlets, not shown, which are adapted to be connected to a point of use or discharge to the surrounding environment. Note that due to the central location of hot gas intake port 42, the seal assemblies and bearing assemblies are remote therefrom and thus relieved of the high temperatures of the intake gas, thereby eliminating leakages due to seal deformation caused by the hot intake temperatures.

Figure 2:
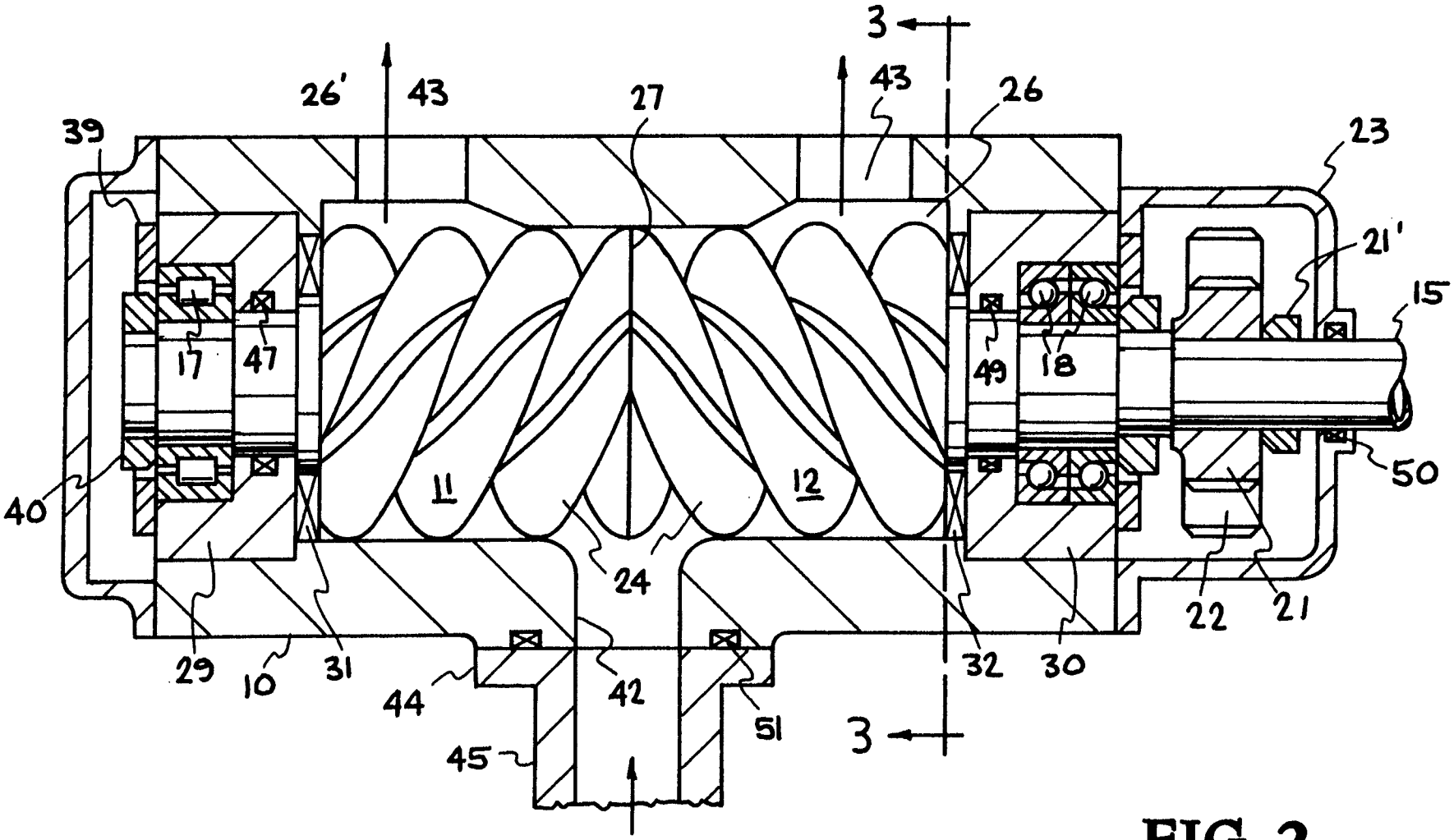
FIG. 2 is a side view of the embodiment of FIG. 1 with a portion of the casing removed and illustrating the intake and exhaust ports.
Figure 3:
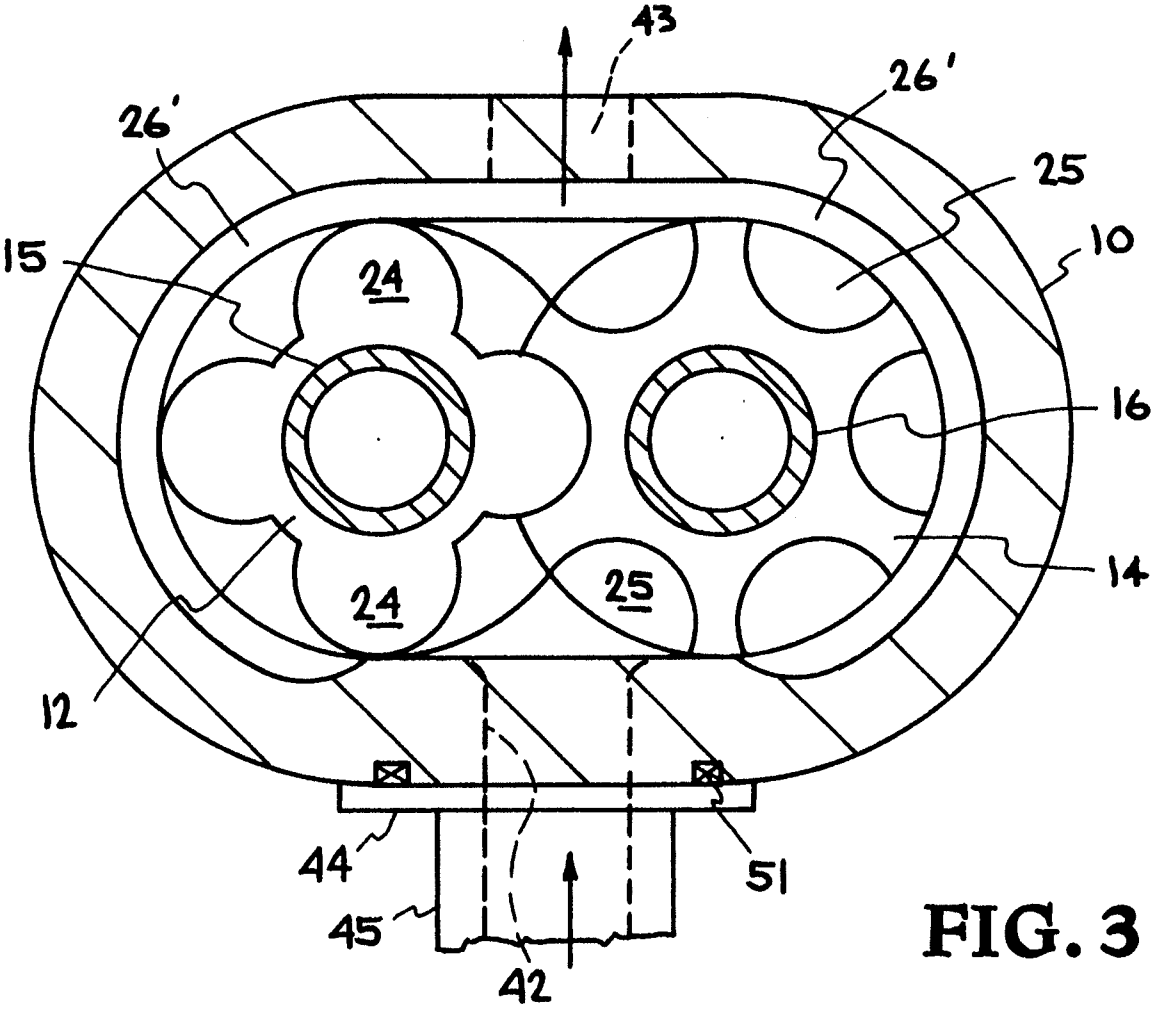
FIG. 3 is a view taken along the line 3—3 of FIG. 2, illustrating an end view of the rotors of the expander.

As seen in FIGS. 1 and 2 seals 46–47 and seals 48–49 are located in grooves in end plates 29 and 30 so as to provide sealing around shafts 15 and 16, while a seal 50 is located in a groove in housing 23 around output shaft 15(41), and a seal 51 is located in a groove in case 10 adjacent flange 44.

The casing 10, hollow core rotors 11–14 and end plates 29 and 39 are constructed of ceramic material, preferably reaction bonded silicon nitride, the hollow shafts 15 and 16 are constructed of a low expansivity metal, such as molybdenum or tantalum alloy, and the synchronizing gears 21 and 22 may be constructed of conventional tool steel.

In operation, hot gas from a source, not shown, passes through conduit 45 and intake port 42, as indicated by the arrow in FIGS. 2 and 3, to the intake zone 26 (see FIG. 1) and expands outwardly between the lobes 24 and the grooves 25 driving the rotors as known in the herringbone rotor art, and exhausts via ports 26' located at the periphery and ends of the tandem rotors, as indicated by the arrows in FIGS. 2 and 3, thereby rotating shafts 15 and 16 and PTO 41.

The operation of helical or herringbone rotor expanders, and the understanding of the need for maintaining critical clearances between the male and female rotors and between the rotors and the casing, is known in the art, as exemplified by the above-referenced Lysholm and Nilsson patents. Thus, further description of the basic operation of the helical expander embodiment illustrated in FIGS. 1–3 is deemed unnecessary.

It has been shown by the present invention that ceramic helical rotor expanders have the capability of operating at inlet temperatures of at least 1100° C. (1100°–1400° C. for example). Also, by the double-ended rotor, central intake port, and outer seal and bearing arrangement of the present invention, the prior problems associated with improper operation of seals and bearings due to the intake temperatures is eliminated or substantially reduced. In addition, by constructing the hollow core rotors and the casing in which the rotors are mounted from a low expansivity material, such as reaction bonded silicon nitride, the prior problems due to critical clearances of these components have been overcome, while enabling the construction of herringbone rotor expanders, thus substantially advancing the state of the art of ceramic helical rotor-machines. While the principals of this invention have been directed to a helical expander, certain of these principals may be utilized in helical compressors, pumps, etc.

While the invention has been described as incorporating synchronized gears and thrust bearings, the opposed helices are believed in at least some applications to provide self synchronization and centering, obviating the need for the synchronized gearing and/or thrust bearings.

While a particular embodiment of the invention has been illustrated and described, such is not intended to limit the invention to this specific embodiment or to the exemplified parameters, materials, etc. Modification, changes and application of components thereof for other uses will become apparent to those skilled in the art, and the scope of the invention should be limited by the appended claims.

What is claimed is:

1. A helical rotor apparatus comprising:

a casing including a body section and end sections, at least entire body section being constructed of reaction bonded silicon nitride;

a first pair of rotors interconnected at inner ends thereof and having helical lobes thereon, said lobes on one of said rotors interconnecting at a point with lobes on another of said rotors, said lobes on each of said rotors extending at an angle from said interconnecting point thereof;

a second pair of rotors interconnected at inner ends thereof and having helical grooves thereon, said grooves on one of said rotors interconnecting at a point with grooves on another of said rotors, said grooves extending at an angle from said interconnecting point thereof;

said lobes of said first pair of rotors being constructed to extend into said grooves of said second pair of rotors;

said first pair of interconnected rotors being secured to a first shaft means;

said second pair of interconnected rotors being secured to a second shaft means;

a first pair of bearing assemblies;

a second pair of bearing assemblies;

said first shaft means being mounted in said end sections of said casing via said first pair of bearing assemblies;

said second shaft means being mounted in said end sections of said casing via said second pair of bearing assemblies;

said bearing assemblies each being located adjacent outer ends of said interconnected rotors;

said first shaft means and said second shaft means being interconnected by gears, and one of said shaft means being adapted to be connected to an associated mechanism; and said body section of said casing being provided with at least one intake opening and a plurality of exhaust openings, said intake opening being located in alignment with said inner ends of each pair of interconnected rotors and with said interconnecting points of said lobes and grooves on said rotors defining an intake zone, said exhaust openings being located adjacent said outer ends of said interconnected rotors.

2. The helical rotor apparatus of claim 1, wherein one of said bearing assemblies comprises a thrust bearing.

3. The helical rotor apparatus of claim 1, wherein said first and second pairs of interconnected rotors are constructed of reaction bonded silicon nitride.

4. The helical rotor apparatus of claim 3, wherein said first and second pairs of interconnected rotors include a hollow core.

5. The helical rotor apparatus of claim 1, wherein said end sections of said casing comprises a pair of end plates, said first and second pairs of interconnected rotors being positioned within said body section of said casing, said first and second pairs of bearing assemblies being mounted in said end plates, and said first and second shaft means extending through said end plates.

6. The helical rotor apparatus of claim 1, wherein at least one of said first and second pairs of bearing assemblies include ball-type bearings.

7. The helical rotor apparatus of claim 1, wherein said first and second shaft means each comprise a shaft extending through said interconnected rotors.

8. The helical rotor apparatus of claim 7, wherein each of said shafts are hollow and constructed of a low expansivity material.

9. The helical rotor apparatus of claim 8, wherein said low expansivity material is selected from the group consisting of tantalum alloy and molybdenum alloy.

10. The helical rotor apparatus of claim 1, additionally including a lubrication cage extending around at least said gears.

11. The helical rotor apparatus of claim 1, wherein said gears are of a synchronizing type.

12. A herringbone rotor type expander into which hot medium is directed for expansion therein and thereby driving an output shaft, comprising:

a case including a pair of end plates;

at least said entire case being constructed of reaction bonded silicon nitride;

a pair of interconnected male rotors secured to a first shaft;

a pair of interconnected female rotors secured to a second shaft;

said male rotors and said female rotor being positioned in said case and said first and second shafts extending through bores in said end plates;

one of said shafts constituting said output shaft;

a bearing assembly being positioned in each of said bores in said end plates, extending around said shafts, and located at outer ends of said interconnected rotors;

synchronized gearing connected to one end of each of said first and second shafts;

each of said interconnected male rotors provided with a plurality of outwardly projecting members, an inner end of each of said projecting members on one of said male rotors being in aligned abutment with inner ends of each of said projecting members on another of said male rotors and extending at an angle therefrom;

each of said interconnected female rotors provided a plurality of grooves therein,, an inner end of each of said grooves on one of said female rotors being in aligned abutment with inner ends of each of said grooves on another of said female rotors and extending at an angle therefrom;

said case including a centrally located inlet and a pair of outlets, said centrally located inlet being positioned in fluid communication with said inner ends of said projecting members and said grooves so as to define and inlet zone, each of said pair of outlets being located adjacent outer ends of said projecting members and said grooves;

whereby hot medium directed through said centrally located inlet expands between said male and female rotors causing rotation thereon and rotation of said output shaft, and exhausts through said pair of outlets.

13. The herringbone rotor type expander of claim 12, additionally include lubrication means for at least said synchronized gearing.

14. The herringbone rotor type expander of claim 12, wherein at least one of said bearing assemblies constitutes a thrust bearing for said output shaft.

15. The herringbone rotor type expander of claim 12, wherein each of said male and female rotors are composed of reaction bonded silicon nitride.

16. The herringbone rotor type expanded of claim 15, wherein each of said male and female rotors include a hollow core.

17. The herringbone rotor type expander of claim 16, wherein said end plates are constructed of reaction bonded silicon nitride.

18. The herringbone rotor type expander of claim 17, wherein said first and second shafts are hollow.

19. The herringbone rotor type expander of claim 20, wherein said hollow first and second shafts are constructed of molybdenum or tantalum alloys.

20. The herringbone rotor type expander of claim 19, wherein each of said bearing assemblies included rolling bearings contained therein.

21. The herringbone rotor type expander of claim 20, wherein one of said bearing assemblies include two sets of rolling bearing members, and constitutes a thrust bearing for said output shaft.

22. A double-ended ceramic helical rotor expander comprising:

a pair of double-ended hollow core male rotors;

a pair of double-ended hollow core female rotors;

a housing having a body section and end sections;

each of said pairs of rotors being located in said body section of said housing and connected to a shaft extending through said end sections of said housing;

each of said shafts being mounted in said end sections of said housing via bearing assemblies;

said shafts being interconnected by gearing;

said body section of said housing being provided with a centrally located inlet port and a plurality of exhaust ports;

said male and female rotors and at least said body section of said housing being constructed of reaction bonded silicon nitride, and said shafts being constructed of molybdenum or tantalum alloys;

whereby an associated high temperature fluid is directed through said central inlet port to a point intermediate rotors of each of said pairs of double-ended rotors for driving said rotors via expansion of the fluid and exhausting at outer ends of said rotors via said exhaust ports.

* * * * *